United States Patent [19]

Ravreby

[11] Patent Number: 5,052,575

[45] Date of Patent: Oct. 1, 1991

[54] HOLDER FOR AN ASEPTIC PACKAGE

[75] Inventor: Fred Ravreby, Framingham, Mass.

[73] Assignee: Up & Adam, Inc., Framingham, Mass.

[21] Appl. No.: 535,821

[22] Filed: Jun. 11, 1990

[51] Int. Cl.[5] ..... B65D 17/44

[52] U.S. Cl. ..... 220/278; 220/254; 220/85 H; 220/90.2; 222/183

[58] Field of Search ..... 206/216, 217; 220/85 H, 220/90.2, 90.4, 254, 345, 278, 361, 375; 215/1 A, 100 R; 222/183, 545, 546, 556, 563

[56] References Cited

U.S. PATENT DOCUMENTS

| | | | |
|---|---|---|---|
| 3,372,832 | 3/1968 | Yeater et al. | 220/90.4 |
| 4,066,191 | 1/1978 | Coleman | 220/90.2 |
| 4,148,418 | 4/1979 | Ewing et al. | 220/85 H |
| 4,262,802 | 4/1981 | Laauwe | 220/254 |
| 4,478,346 | 10/1984 | Spong | 220/90.2 |
| 4,561,560 | 12/1985 | Lyon | 222/183 |
| 4,586,622 | 5/1986 | Walldorf | 220/254 |
| 4,756,442 | 7/1988 | Halm et al. | 220/375 |
| 4,790,444 | 12/1988 | Terzi | 220/90.2 |
| 4,899,902 | 2/1990 | DeMars | 220/90.2 |
| 4,974,744 | 12/1990 | Shanklin et al. | 220/90.2 |

OTHER PUBLICATIONS

Carton Cagers Juice Box Holder sold by T.D.J. Inc., 1989.

Sip-Eze Sold by Big Baby Co., Nyack, New York, 1989.

Sipper Gripper Sold by Little Kids, Inc., Providence, Rhode Island, 02906, 1989.

*Primary Examiner*—David T. Fidei

*Attorney, Agent, or Firm*—Wolf, Greenfield & Sacks

[57] ABSTRACT

A holder for an aseptic package including a container, a removable cover, and a stopper disposed beneath the cover when it is positioned in a straw hole on the upper surface of the package, so that the cover holds the stopper securely within the straw hole.

7 Claims, 4 Drawing Sheets

Fig.1
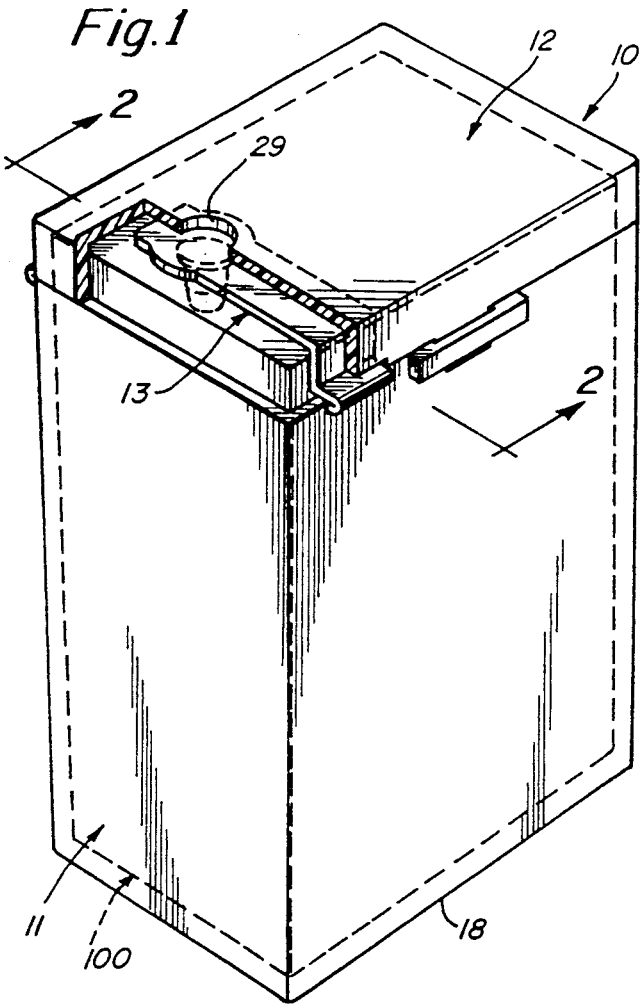
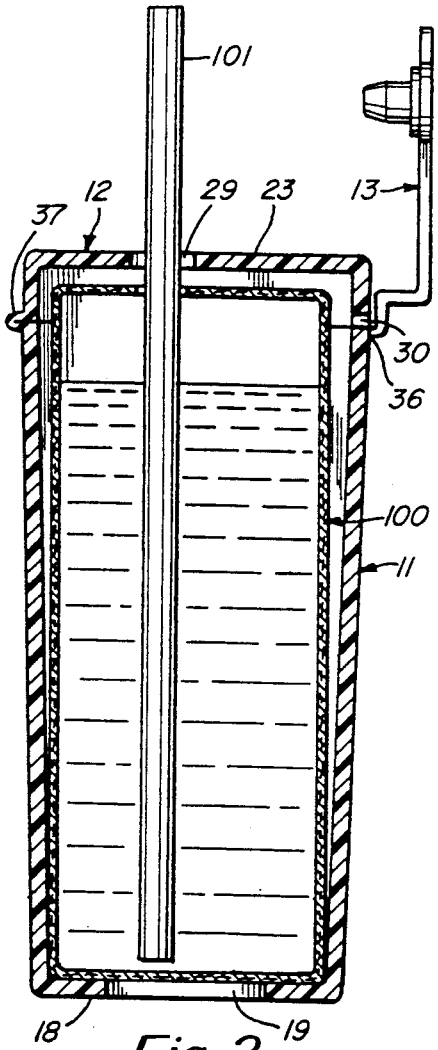
Fig. 2
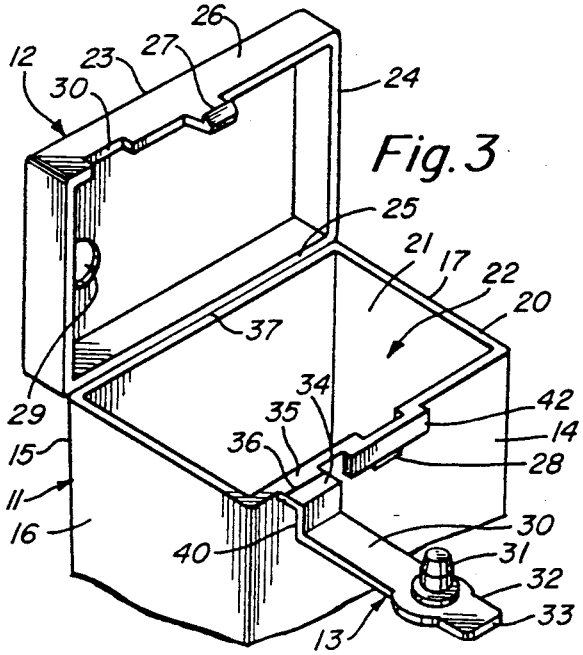
Fig. 3
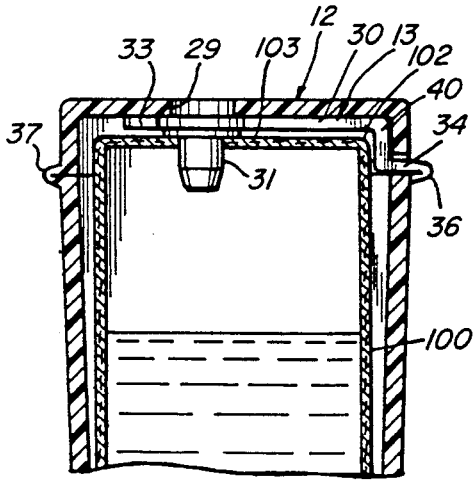
Fig. 4

Fig. 5
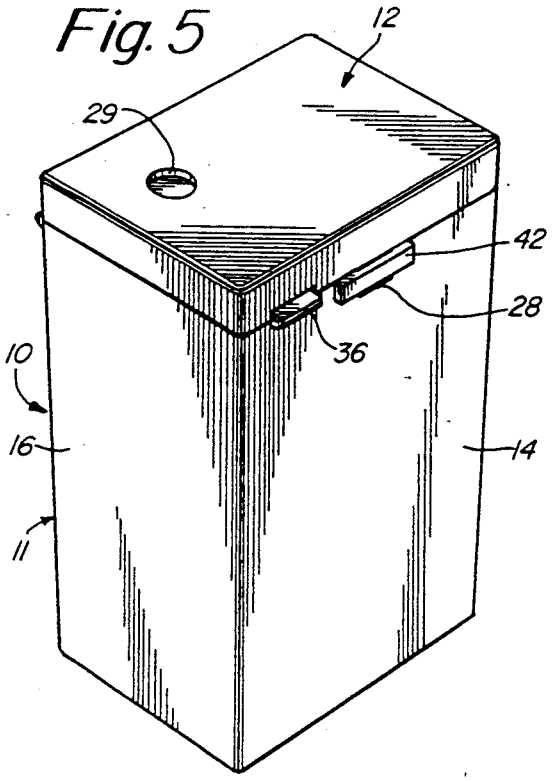
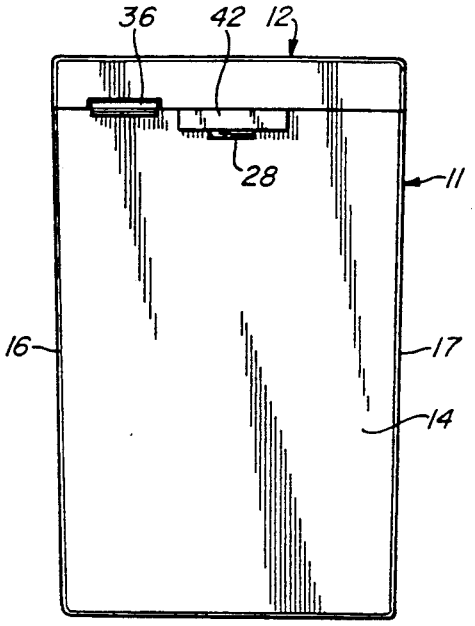
Fig. 6
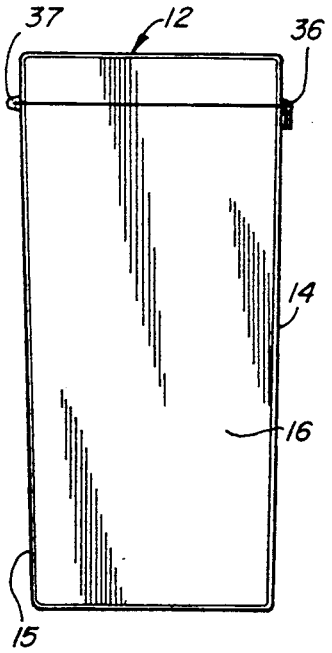
Fig. 7
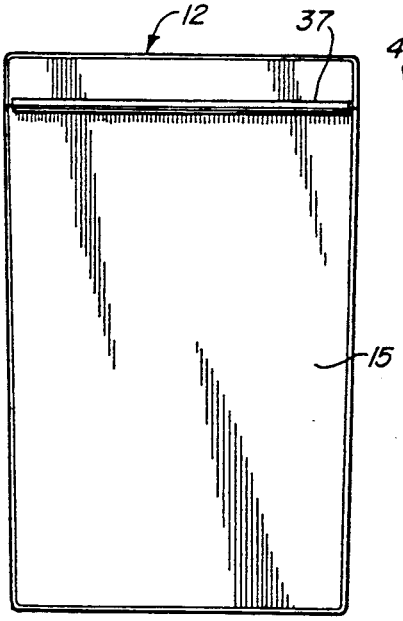
Fig. 8
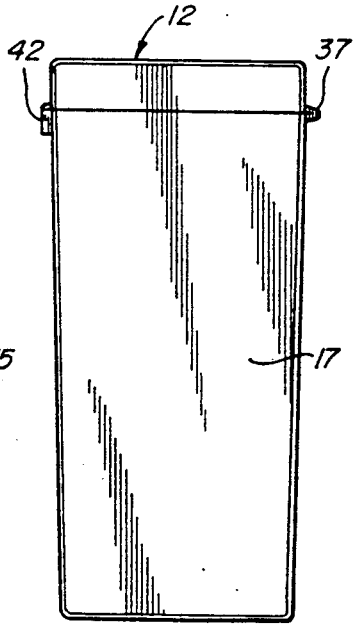
Fig. 9

HOLDER FOR AN ASEPTIC PACKAGE

BACKGROUND OF THE INVENTION

This invention concerns a holder for an aseptic package and more particularly to a holder having a stopper positionable within a straw hole in the top of the aseptic package and securely held therein by a removable cover on the holder.

Aseptic beverage packages are widely used because they do not require refrigeration, are lightweight, disposable, and easy to open. The package comes with a straw which is inserted through a sealed hole on the top surface of the package prior to use. These packages are particularly useful for young children in that when the straw is inserted into the hole the beverage is held in a portable and non breakable container.

Although the packages are designed to hold a single serving, often young children can drink only part of that serving and it would be desirable to provide a way of storing the opened package for later use. Holders have been provided which include a stopper that is releasably positionable within the straw hole, after removing the straw, for saving a partially full package for later use. However, in these known holders, the stopper is a plastic arm having certain resiliency and has a tendency to pop out of the straw hole and is not otherwise securely positionable in the straw hole to prevent accidental dislodgment.

SUMMARY OF THE INVENTION

This invention concerns a holder for an aseptic package which provides a stopper that is securely positionable within the straw hole of the package so as to resist popping out or being accidentally dislodged. Furthermore, the package can be quickly and easily inserted into and removed from the holder. Still further, the holder can be firmly grasped by the user without causing the package to be squeezed, which squeezing tends to cause the beverage to squirt out the straw or the straw hole of the package.

The holder of this invention includes a container having an interior chamber for holding the aseptic package and an upper opening which allows the package to be inserted into the chamber quickly and easily. The opening allows access to the top surface of the package when located within the chamber, and a removable cover is provided for closing the opening. The cover has releasable locking means for securing the cover to the container an securely holding the package within the holder. A stopper is movably attached to the container for temporarily closing the straw hole. The stopper is disposed beneath the cover while the stopper is in the straw hole so that the cover holds the stopper securely within the hole. Thus, the locking means on the cover insures both that the cover holds the stopper within the hole and that the cover holds the package within the chamber.

BRIEF DESCRIPTION OF THE DRAWINGS

FIG. 1 is a top left front prospective view of the holder of this invention, partially broken away to show a stopper disposed within the hole of an aseptic package in the holder.

FIG. 2 is a left side cross-sectional view taken along the section lines 2—2 in FIG. 1, showing the package and straw within the holder and the stopper flipped out.

FIG. 3 is a top left prospective view of an upper portion of the holder showing the cover up and the stopper flipped out, which enables the package to be inserted into or removed from the holder.

FIG. 4 is a fragmentary cross sectional view similar to FIG. 2, but with the stopper in place in the straw hole.

FIG. 5 is a top left front prospective view of the holder with the stopper folded inside.

FIG. 6 is a front elevational view of the holder with the stopper inside.

FIG. 7 is a left side elevational view of the holder with the stopper inside.

FIG. 8 is a rear elevational view of the holder with the stopper inside.

FIG. 9 is a right side elevational view of the holder with the stopper inside.

DETAILED DESCRIPTION OF THE PREFERRED EMBODIMENT

Figure 10:
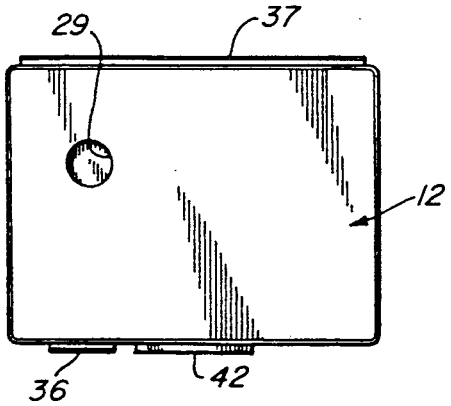
FIG. 10 is a top plan view of the holder with the stopper inside.
Figure 11:
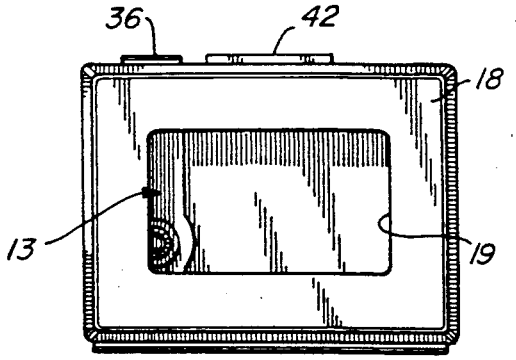
FIG. 11 is a bottom plan view of the holder with the stopper inside.
Figure 12:
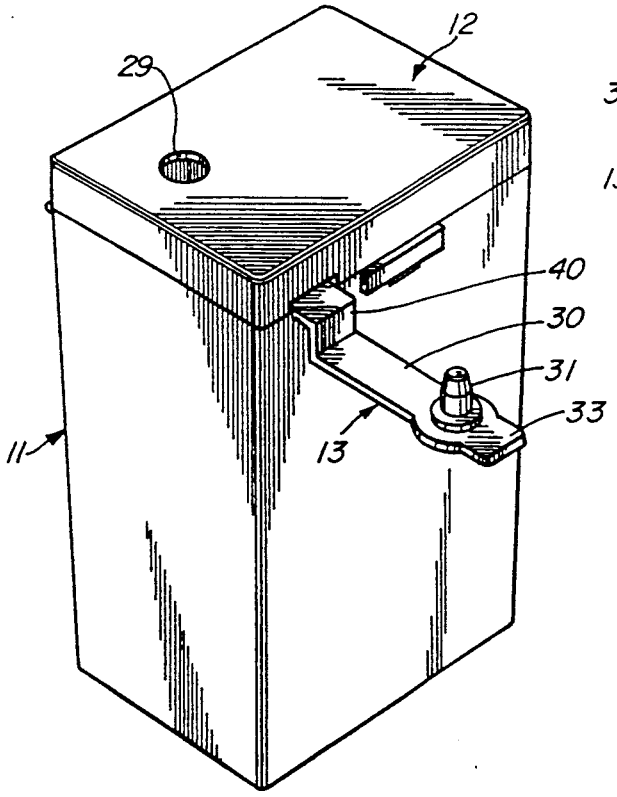
FIG. 12 is a top left front prospective view of the holder, but with the stopper flipped out.
Figure 13:
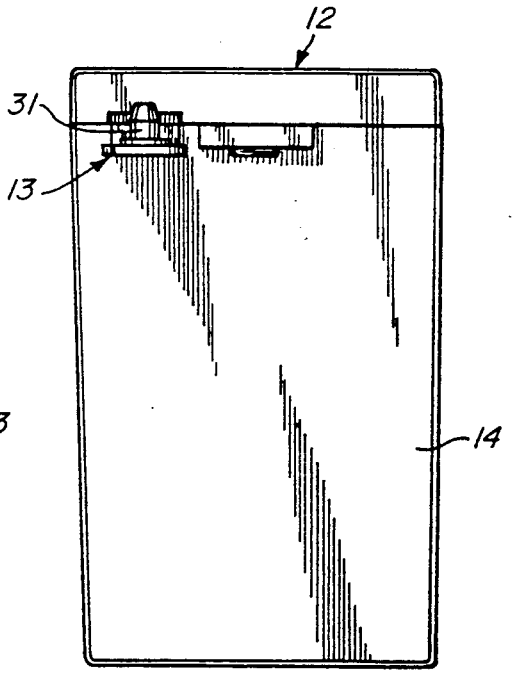
FIG. 13 is a front elevational view with the stopper out, the rear elevational view being identical to FIG. 8.
Figure 14:
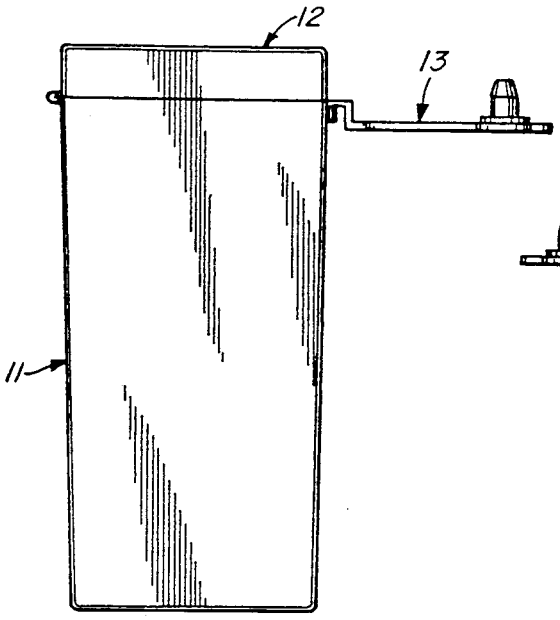
FIG. 14 is a left side elevational view of the holder with the stopper out.
Figure 15:
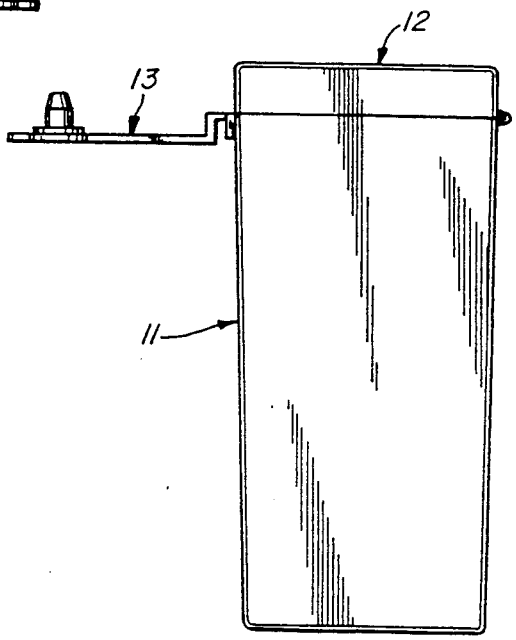
FIG. 15 is a right side elevational view of the holder with the stopper out.
Figure 16:
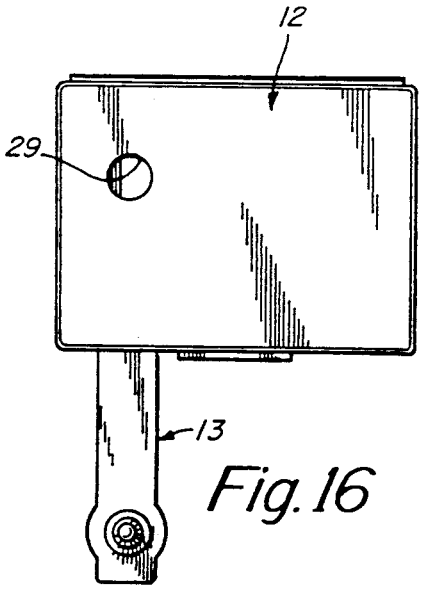
FIG. 16 is a top plan view of the holder with the stopper out.
Figure 17:
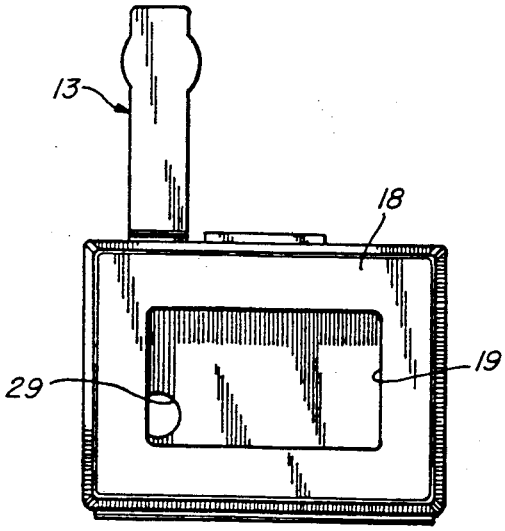
FIG. 17 is a bottom plan view of the holder with the stopper out.

A preferred embodiment of this invention is shown in FIGS. 1–17 wherein the holder is designed to hold a rectilinear 8.45 ounce aseptic beverage package or juice box. It is understood that the holder may be adapted for packages of other sizes or dimensions.

FIG. 1 shows a holder 10 which includes a lower container 11, an upper cover or lid 12, and a movable stopper 13. The container is rectilinear, having four vertical walls 14–17, a lower wall 18 with a central opening 19, and is completely open at its upper edge 20 to form an upper opening 21 (FIGS. 2–3). The sidewalls include opposed front and rear walls 14, 15 and opposed side walls 16, 17. The sidewalls 14–17 and lower wall 18 form a rectilinear interior chamber 22 which is shaped to hold and snugly engage an aseptic package 100. The sidewalls 14–17 diverge slightly outwardly going from the bottom to the top for ease of inserting the package into the container (FIG. 2).

The cover 12 has a top wall 23 with a downwardly extending lip 24 on all four sides which engages the upper edge 20 of the container. The cover has a rear edge 25 which is connected by a hinge 37 to the top edge of the rear side wall 15 of the container, to allow the cover to be flipped open and flipped shut. The front lip 26 on the cover has a downwardly extending resilient tab 27 which is releasably positionable within a tab receiving opening 28 formed beneath a cross bar 42 adjacent the upper edge of the front wall 14 of the lower container. This resilient and releasable locking means temporarily secures the cover to the container once the package is disposed within the chamber to securely hold the package in the holder and, as described hereinafter, to securely hold the stopper within the straw hole. The cover further includes a circular straw hole 29 on a left portion of the top wall 23. A cut out notch 30 is provided in the front lip of the cover in alignment with the straw hole to provide clearance for the stopper as described hereinafter.

FIG. 2 shows the package 100 disposed in the holder with a straw 101 inserted in the package and extending through the straw hole 29 in the top wall of the cover. The stopper 13 has been flipped out of the container. The sidewalls 14–17 are sufficiently stiff so that the holder may be firmly grasped without squeezing the package and causing the beverage to squirt out the top of the straw.

If a user desires to save a portion of the contents of the package for later use, the straw is removed from the package, the cover is flipped open, the straw is inserted into the container (extra space being provided between the package and inner wall of the container), the stopper is flipped down into the straw hole, and the cover is then reclosed. As shown in FIGS. 1 and 4, the stopper 13 is disposed beneath the cover, which prevents the stopper from popping out or being accidentally dislodged from the hole. The stopper includes an arm 30 having a downwardly extending circular projection 31 for sealing the straw hole. The projection is adjacent a first end 32 of the arm and the first end has a shaped tab 33 to enable the user to insert a finger beneath the tab to remove the projection 31 from the straw hole. At its opposite second end 34 the arm is connected to the upper edge 35 of the front wall of the container by a hinged portion 36. In this preferred embodiment, the entire container is made of plastic, preferably by injection molding. The hinge 37 for the cover and the hinge 36 for the stopper arm are integral portions of the holder, having sufficient flexibility to function as a hinge. Adjacent the second end of the arm is a right angle shoulder 40 which fits around the upper edge 102 of the package (see FIG. 4) so that the arm 30 lies parallel to the top wall 103 of the package and the top wall 12 of the cover, and in contact with the underside of the top wall 12.

FIGS. 5–17 further illustrate various views of the holder. In FIGS. 5–11 the holder is shown with the stopper flipped in, and FIGS. 12–17 with the stopper flipped out.

Although a preferred embodiment of the invention has hereinbefore been described, it will be appreciated that variations of this invention will be perceived by those skilled in the art, which variations are nevertheless within the scope of this invention as defined by the claims appended hereto.

What is claimed is:

1. A holder adapted for resealing an aseptic package with a straw hole in its top surface, the holder comprising:

a lower container having an interior chamber adapted to hold the package, the container having an upper opening through which the package may be inserted into the chamber and which allows access to the top surface of the package;

a cover having locking means for releasably securing the cover to the container for retaining the package in the chamber, the cover having an aperture adapted to receive a straw and juxtaposed over the hole in the package; and a stopper having a movable arm attached to the lower container adjacent to the upper opening and a projection on the arm adapted to releasably seal the straw hole, the arm being movable to a first position wherein the arm lies under the cover and the projection seals the straw hole whereby the locking means retains both the package in the holder and the projection in the hole, and a second position wherein the projection is removed from the hole and which allows a straw to be inserted through the aperture and into the package while the cover is closed and the locking means retains the package in the holder.

2. The holder of claim 1, wherein the stopper arm is connected to the upper edge of the container by a hinge.

3. The holder of claim 1, wherein the stopper is outside of the cover and container while in the second position.

4. The holder of claim 1, wherein the cover is movably attached to the container by a hinge.

5. The holder of claim 1, wherein the holder is an integral plastic body.

6. The holder of claim 1, wherein the arm further includes a tab adjacent the projection for facilitating removal of the projection from the straw hole.

7. The holder of claim 1, wherein the releasable locking means includes a resilient tab on the cover which is postionable within a tab receiving opening in the container.

* * * * *

UNITED STATES PATENT AND TRADEMARK OFFICE

CERTIFICATE OF CORRECTION

PATENT NO. : 5,052,575

DATED : October 1, 1991

INVENTOR(S) : Ravreby

It is certified that error appears in the above-identified patent and that said Letters Patent is hereby corrected as shown below:

Col. 1, line 51 - delete "an" and substitute therefore -- and --.

Col. 1, line 62 - delete "prospective" and substitute therefore -- perspective --.

Col. 2, line 1 - delete "prospective" and substitute therefore -- perspective --.

Col. 2, line 8 - delete "prospective" and substitute therefore -- perspective --.

Col. 2, line 22 - delete "prospective" and substitute therefore -- perspective --.

Signed and Sealed this

Second Day of March, 1993

*Attest:*

STEPHEN G. KUNIN

*Attesting Officer*

*Acting Commissioner of Patents and Trademarks*